US008784052B2

(12) United States Patent
Shi et al.

(10) Patent No.: US 8,784,052 B2
(45) Date of Patent: Jul. 22, 2014

(54) CERAMIC GAS TURBINE SHROUD

(75) Inventors: Jun Shi, Glastonbury, CT (US); Kevin E. Green, Broad Brook, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1108 days.

(21) Appl. No.: 12/776,673

(22) Filed: May 10, 2010

(65) Prior Publication Data

US 2011/0274538 A1 Nov. 10, 2011

(51) Int. Cl.
*F04D 29/02* (2006.01)

(52) U.S. Cl.
USPC ..... 415/197; 415/200; 415/213.1; 415/214.1

(58) Field of Classification Search
USPC ..... 415/213.1, 214.1, 215.1, 196, 197, 200
See application file for complete search history.

(56) References Cited

U.S. PATENT DOCUMENTS

| | | | | |
|---|---|---|---|---|
| 4,008,978 | A | 2/1977 | Smale | |
| 4,325,647 | A * | 4/1982 | Maier et al. | 403/29 |
| 4,398,866 | A | 8/1983 | Hartel et al. | |
| 4,643,636 | A * | 2/1987 | Libertini et al. | 415/138 |
| 4,759,687 | A | 7/1988 | Miraucourt et al. | |
| 5,411,368 | A | 5/1995 | Chase et al. | |
| 6,250,883 | B1 | 6/2001 | Robinson et al. | |
| 6,431,781 | B1 * | 8/2002 | Schenk | 403/29 |
| 6,733,233 | B2 * | 5/2004 | Jasklowski et al. | 415/135 |
| 6,997,673 | B2 | 2/2006 | Morris et al. | |
| 7,255,538 | B2 | 8/2007 | Shi | |
| 7,442,011 | B2 * | 10/2008 | Negulescu et al. | 416/221 |
| 7,686,575 | B2 * | 3/2010 | Chehab et al. | 415/136 |
| 2008/0112803 | A1 | 5/2008 | Shi et al. | |
| 2008/0273964 | A1 * | 11/2008 | Ellis et al. | 415/119 |
| 2009/0208322 | A1 | 8/2009 | McCaffrey | |

FOREIGN PATENT DOCUMENTS

| | | | |
|---|---|---|---|
| JP | 9264104 | | 10/1997 |
| JP | 09264104 A | * | 10/1997 |

* cited by examiner

*Primary Examiner* — Nathaniel Wiehe
*Assistant Examiner* — Adam W Brown
(74) *Attorney, Agent, or Firm* — Carlson, Gaskey & Olds, P.C.

(57) ABSTRACT

An example gas turbine engine shroud includes a first annular ceramic wall having an inner side for resisting high temperature turbine engine gasses and an outer side with a plurality of radial slots. A second annular metallic wall is positioned radially outwardly of and enclosing the first annular ceramic wall and has a plurality of tabs in communication with the slot of the first annular ceramic wall. The tabs of the second annular metallic wall and slots of the first annular ceramic wall are in communication such that the first annular ceramic wall and second annular metallic wall are affixed.

8 Claims, 3 Drawing Sheets

CERAMIC GAS TURBINE SHROUD

STATEMENT REGARDING FEDERALLY SPONSORED RESEARCH OR DEVELOPMENT

This invention was made with government support under Contract No. DE-FC26-00CH11060 awarded by the United States Department of Energy. The Government has certain rights in this invention.

BACKGROUND OF THE INVENTION

Gas turbine engine components are often exposed to high temperatures. Such engine components can be found in the turbine section of a gas turbine engine and include a gas turbine shroud surrounding the turbine blades. Conventional turbine shrouds are made from metallic materials that require substantial cooling in order to withstand the high temperature of combustion gasses within the turbine engine.

Generally there is a clearance between the tips of rotatable turbine blades and the inner surface of the shroud to prevent rubbing between the two during engine transient. If the turbine blades are made of ceramics, the low density and high stiffness characteristics of ceramics further reduce radial displacement of the turbine blade, thereby increasing the tip clearance between the ceramic blade and metallic casing resulting in a higher percentage of core flow leaking instead of being transferred from gas flow.

SUMMARY OF THE INVENTION

An example gas turbine engine shroud includes a first annular ceramic wall having an inner side for resisting high temperature turbine engine gases and an outer side with a plurality of radial slots. A second annular metallic wall is positioned radially outwardly of and enclosing the first annular ceramic wall and has a plurality of tabs in communication with the slot of the first annular ceramic wall. The tabs of the second annular metallic wall and slots of the first annular ceramic wall are in communication such that the first annular ceramic wall and second annular metallic wall are affixed.

Another example gas turbine engine shroud includes a first annular ceramic wall having an inner side in contact with high temperature turbine engine gases and an outer side including a plurality of radial tabs. A second annular metallic wall is disposed radially outwardly of the first annular ceramic wall and has a plurality of attachment means. A spring is attached to the second annular metallic wall by at least one of the attachment means. The spring is also in communication with at least one tab of the first annular ceramic wall. The first annular ceramic wall and second annular metallic wall are affixed.

An example gas turbine engine includes a compressor section, a combustor fluidly connected with the compressor section and a turbine section downstream from the combustor. The turbine section has a ceramic wall that includes an inner side for resisting high temperature turbine engine gases and an outer side including a tab, as well as a metallic wall enclosing the ceramic wall and including a slot in communication with the tab of the ceramic wall. The tab of the ceramic wall and slots of the metallic wall are in communication such that the inner ceramic wall and outer metallic wall are affixed.

These and other features of the present invention can be best understood from the following specification and drawings, the following of which is a brief description.

BRIEF DESCRIPTION OF THE DRAWINGS

The various features and advantages in the disclosed examples will become apparent to those skilled in the art from the following detailed description. The drawings that accompany the detailed description can be briefly described as follows.

DETAILED DESCRIPTION

Figure 1:
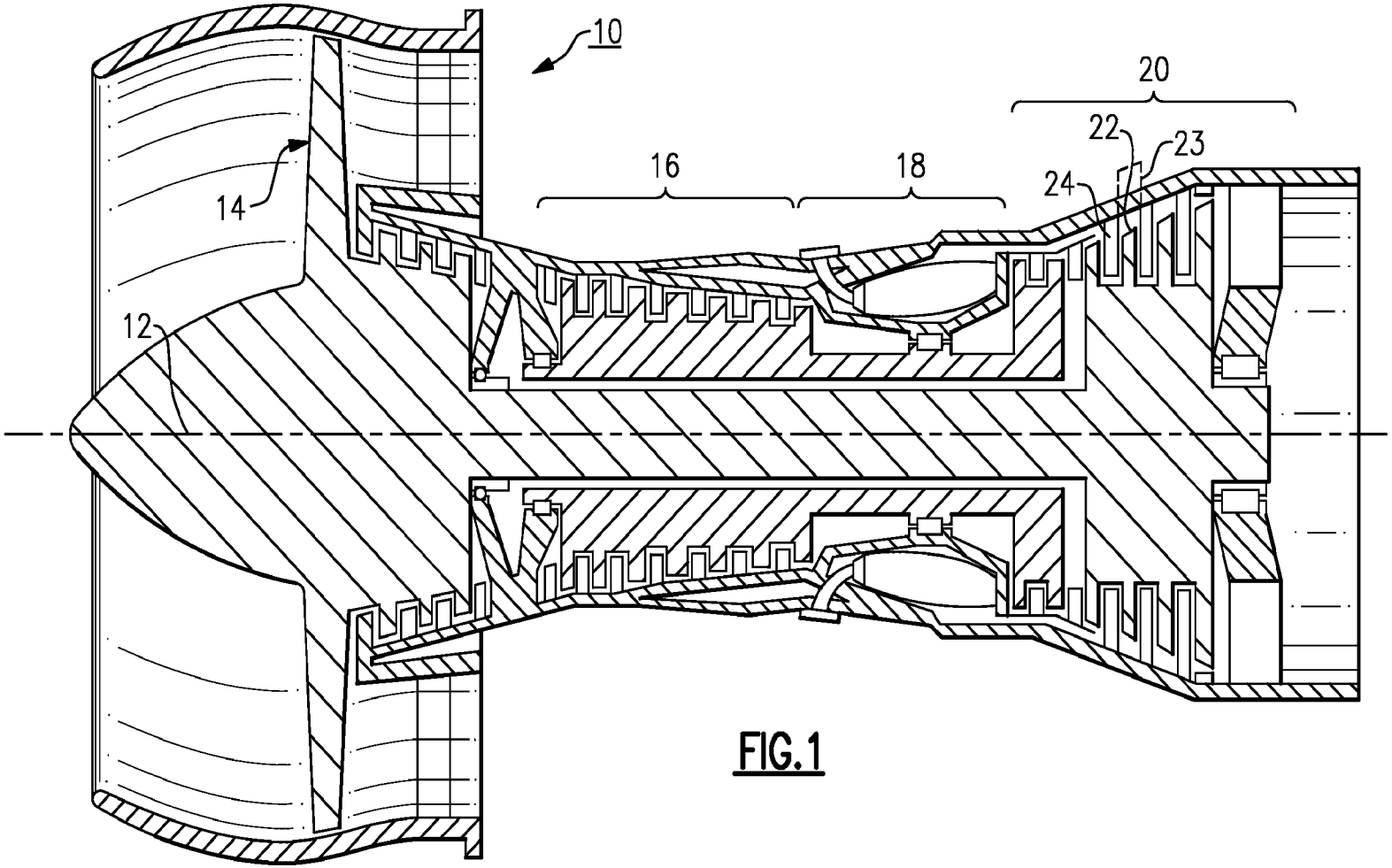
FIG. 1 is a sectional view of example gas turbine engine.

In exemplary embodiments, clearance between the tips of rotatable turbine blades and an inner surface of a shroud of a gas turbine engine is controlled to reduce leakage losses. This may be achieved by using low thermal expansion materials for the shroud, such as ceramics. Referring to FIG. 1, selected portions of an example gas turbine engine 10, such as a gas turbine engine 10 used for propulsion, are shown. In this example, the gas turbine engine 10 is circumferentially disposed about an engine centerline 12, wherein the engine centerline 12 defines an axis of FIG. 1. The gas turbine engine 10 may include a fan 14, a compressor section 16, a combustion section 18, and a turbine section 20 that includes rotating turbine blades 22 and stator turbine vanes 24. It is to be understood that other types of engines may also benefit from the examples disclosed herein, such as engines that do not include a fan or engines having other types of compressors, combustors, and turbines than shown including high temperature environments. The casing section 23 of the gas turbine engine 10 (shown schematically in FIG. 1) includes a first and second wall which together form the casing section 23.

Figure 2A:
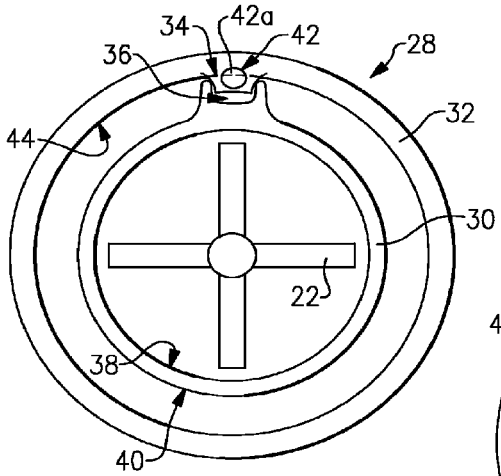
FIG. 2*a* is a cross-sectional schematic view of an example gas turbine engine shroud with a first annular ceramic wall and a second annular metallic wall taken along the axis of FIG. 1.
Figure 2B:
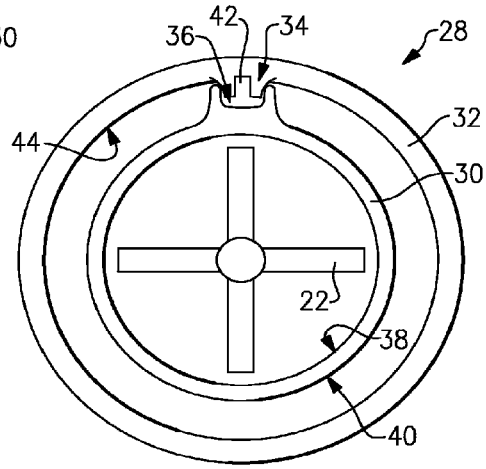
FIG. 2*b* is a cross-sectional schematic view of an example gas turbine engine shroud with a first annular ceramic wall and a second annular metallic wall taken along the axis of FIG. 1.

Referring to FIGS. 2*a* and 2*b*, with continued reference to FIG. 1, selected portions of the turbine section 20 are shown taken along the axis of FIG. 1. A gas turbine engine shroud 28 is shown including a first annular wall 30, a second annular wall 32 that could be part of the turbine casing, and rotating turbine blades 22. Although shown enclosing rotating turbine blades 22, it is within the contemplation of this disclosure that the gas turbine engine shroud 28 may enclose other gas turbine engine components. The second annular wall 32 encloses the first annular wall 30 such that the outer side 40 of the first annular wall 30 is facing the inner side 44 of the second annular wall 32. The inner side 38 of the first annular wall 30 is in contact with high temperature combustion gasses from operation of the gas turbine engine 10 and due to the first annular wall's 30 ability to withstand high temperatures, minimizes blade tip clearance, and reduces air cooling requirements within the turbine section 20.

The first annular wall 30 includes a slot 36 formed as part of the first annular wall 30. Although only one slot 36 is shown in this example, the disclosure contemplates any number of slots 36 being located along the first annular wall 30. The slots 36 are located radially around the first annular wall 30 and are disposed longitudinally along the first annular wall 30. The slot 36 may protrude from the first annular wall 30 towards the inner side 44 of the second annular wall 32. The second annular wall 32 includes a tab 34 which protrudes radially out from the second annular wall 32 and is shaped to allow communication with the slot 36 of the first annular wall 30. The tab 34 is similarly disposed longitudinally along the second annular wall 32 to mate with the longitudinal slot 36. The slot 36 is aligned with the tab 34 such that the tab 34 is moved into the slot 36 to affix the first annular wall 30 and second annular wall 32.

The tab 34 of the second annular wall 32 includes an opening 42 extending completely through the tab 34 parallel to the axis of FIG. 1. An example opening 42 is a circular hole, as shown in FIG. 2*a*, which may be drilled out of the second annular wall 32 after machining. A portion 42*a* of the opening 42 may extend beyond the tab 34 and into the second annular wall 32. Another example opening 42 is shown in FIG. 2*b*, as a rectangular opening which may be cut out after machining of the second annular wall 32. This disclosure is not limited to the above configurations as it contemplates any geometrical shape which can be configured to fit within the tab 34 and second annular wall 32 to tailor the contact stiffness. The openings 42 serve to increase ductility by allowing the tab 34 to more easily deform when heated/loaded, making the tab 34 less stiff. Increased ductility resulting in decreased stiffness due to the openings 42 reduces stress from the turbine environment between the tab 34 and slot 36, such that providing a metallic tab 34 which expands with greater ease allows for increased affixability between the first annular wall 30 and the second annular wall 32 as well as decreased chance of cracks or breaks in the tab 34 or slot 36.

An example tab 34 may be separately made with an opening 42 and then machined and attached to the second annular wall 32 using known methods, allowing for easier creation of openings 42 within the tab 34. The example tab 34 and second annular wall 32 are made of metallic materials, allowing for efficient attachment. The opening 42 is primarily located within the bounds of the surface area of the tab 34, however, it may extend into the second annular wall 32 as shown. When the tab 34 portion of the second annular wall 32 is in communication with the slot 36 portion of the first annular wall 30, the first annular wall 30 and second annular wall 32 are affixed.

In an exemplary embodiment, the first annular wall 30 is made of ceramic material. The ability of the first annular wall 30 to withstand high temperatures and have reduced air cooling requirements is due to the ceramic makeup of the first annular wall 30, which is more heat and corrosion resistant than metal as well as being of a lower density and higher stiffness. The second annular wall 32 may be made of a suitable metallic material, such as metals or metal alloys known in the art.

Figure 3A:
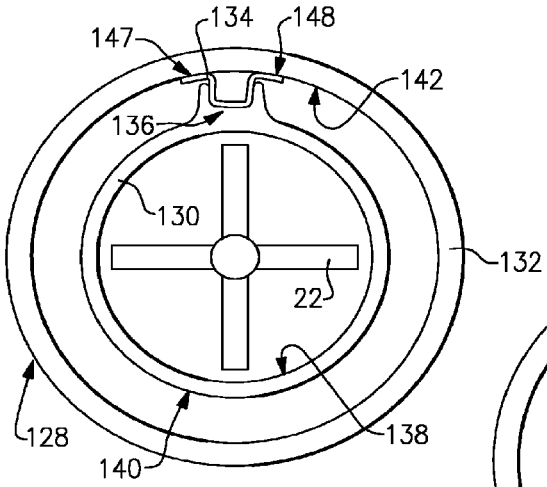
FIG. 3*a* is a cross-sectional schematic view of an example gas turbine engine shroud including a spring strap taken along the axis of FIG. 1.

Referring to FIG. 3*a*, with continued reference to FIGS. 1, 2*a* and 2*b*, an example gas turbine engine shroud 128 is shown. The example gas turbine engine shroud 128 includes a first annular wall 130 and a second annular wall 132. The second annular wall 132 encloses the first annular wall 130 such that the inner side 142 of the second annular wall 132 is facing the outer side 140 of the first annular wall 130. The first annular wall 130 includes a slot 136 which faces the inner side 142 of the second annular wall 132. The slot 136 is located radially around the first annular wall 130 and is disposed longitudinally along the first annular wall 130. The slot 136 may protrude out of the outer side 140 of the first annular wall 130 towards the inner side 142 of the second annular wall 132. A spring strap 134 is also provided and is attached to the second annular wall 132 at two attachment points 147, 148. At the first attachment point 147, the spring strap 134 may be welded onto the second annular wall 132. At a second attachment point 148, the spring strap 134 can be riveted or bolted onto the second annular wall 132. The spring strap 134 reduces stress between the first annular wall 130 and the second annular wall 132 by being designed to fit within the slot 136 of the first annular wall 130 to attach the first annular wall 130 to the second annular wall 132. Although only one spring strap 134 and slot 136 is shown, it is within the contemplation of this disclosure that any number of spring straps 134 and slots 136 may be used. Although the spring strap 134 as shown conforms to the shape of the slot 136, it is also within the contemplation of this disclosure that the spring strap 134 is designed to not be in communication with the entire slot 136. The spring strap 134 can be a nickel based alloy. However, it is within the contemplation of this disclosure that the spring strap 134 can be made of any material based on environmental needs.

Figure 3B:
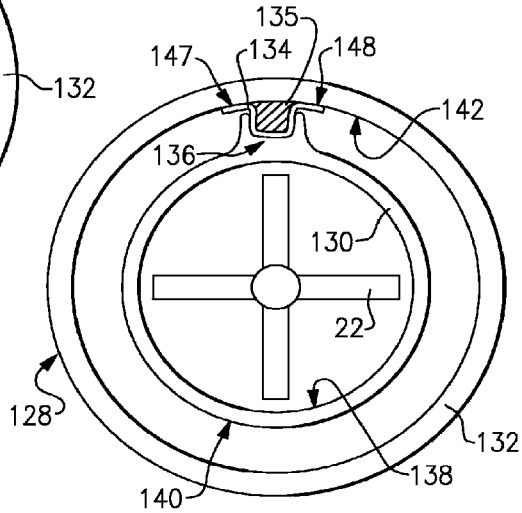
FIG. 3*b* is another cross-sectional schematic view of an example gas turbine engine shroud including a spring strap and tab along the axis of FIG. 1.

Referring to FIG. 3*b*, the spring strap 134, may also be employed between the slot 136 and a tab 135. The spring strap 134 serves as an additional aide to affixing the first annular wall 130 to the second annular wall 132 as well as reducing the stresses on both the slot 136 and tab 135 due to the flexibility of spring strap 134, which takes the place of the slot 136 and tab 135 in receiving stresses.

Figure 4:
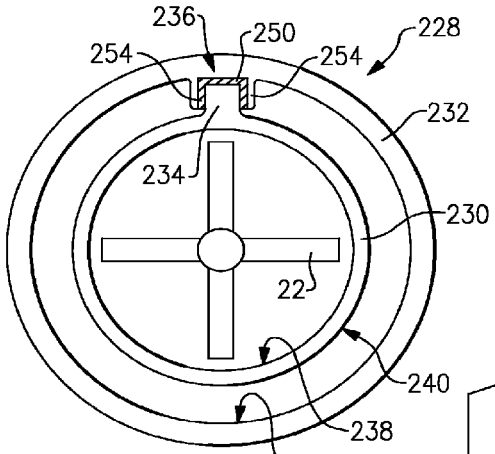
FIG. 4 is a cross-sectional schematic view of another example gas turbine engine shroud with first annular ceramic wall and a second annular metallic wall.

Referring to FIG. 4, another example gas turbine engine shroud 228 is shown.

The example gas turbine engine shroud 228 includes a first annular wall 230, made of ceramic and a second annular wall 232, made of known metallic materials. The second annular wall 232 encloses the first annular wall 230 such that inner side 242 of the second annular wall 232 faces the outer side 240 of the first annular wall 230. The inner side 238 of the first annular wall 230 is in contact with high temperature combustion gasses, and due to being made of ceramic, has a reduced air cooling requirement in comparison to a metallic inner wall and is able to resist the high temperature combustion gasses. The first annular wall 230 has a tab 234 extending out from the outer side 240 of the first annular wall 230. The tab 234 is in communication with a slot 236 of the second annular wall 232. The tab 234 and slot 236 are arranged to be in communication such that the tab 234 and slot 236 affix the first annular wall 230 to the second annular wall 232. The slot 236 is located radially around the second annular wall 232 and is disposed longitudinally along the second annular wall 232, while the tab 234 is also radially located and longitudinally disposed along the first annular wall 230.

The slot 236 of the second annular wall 232 is formed by lips 254 which are preformed with the second annular wall 232. Because the lips 254 of the second annular wall 232 are metallic, there is increased ductility of the lips 254 in comparison to lips 254 made of ceramic, to reduce cracks in the gas turbine engine shroud 228. Although the example shroud 228 only shows one tab 234 and slot 236, it is within the contemplation of this disclosure that numerous tabs 234 and slots 236 may be employed.

In one example, the slot 236 of the metallic second annular wall 232 is in communication with a strip 250 of compliant material, such as plating. The strip 250 is of a material that provides better affixability to the ceramic tab 234. An example compliant material would be a strip 250 of gold, which has ductile and malleable characteristics. However, it is within the contemplation of this disclosure to use other compliant ductile or malleable materials. When exposed to heat, the strip 250 exhibits its ductility, increasing the ability of the metallic second annular wall 232 to affix to the ceramic first annular wall 230.

Figure 5:
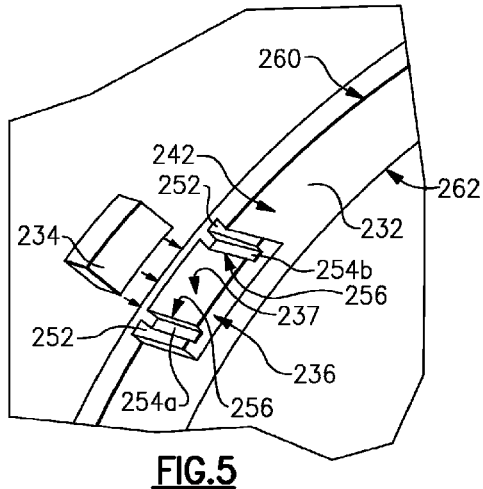
FIG. 5 is a partial sectional view of an embedded slot within the second annular metallic wall of the gas turbine engine shroud of FIG. 4.

Referring to FIG. 5, with continued reference to FIG. 4, an example slot 236 of the second annular wall 232 is shown. The slot 236 may be formed by removing a portion of the second annular wall 232 through known methods, such that the slot 236 is embedded in the second annular wall 232, as opposed to protruding above the inner side 242 of the second annular wall 232. The tab 234 is inserted into the slot 236 on the inner side 242 of the second annular wall 232 such that the tab 234 and slot 236 are in communication affixing the second annular wall 232 and first annular wall 230.

The slot 236 is defined by two protruding lips 254*a*, 254*b*. The affixment region 237 of the slot 236 is located on the jointly facing sides 256 of the lips 254*a*, 254*b*. There is also an expansion space 252 between the lips 254*a*, 254*b* and the end of the slot 236. This extra expansion space 252 allows for further ductility and thermal expansion of the metallic materials of the second annular wall 232. The depth of the slot 236 can be determined based upon the thickness of the second annular wall 232, the thickness of the tab 234, and environmental factors that present themselves in use. In one example, the slot 236 extends only part of the distance between the front side 260 and the back side 262. However, it is within the contemplation of the disclosure that the slot 236 may extend to cover any distance, including the entirety, between the front side 260 and the back side 262.

Figure 6:
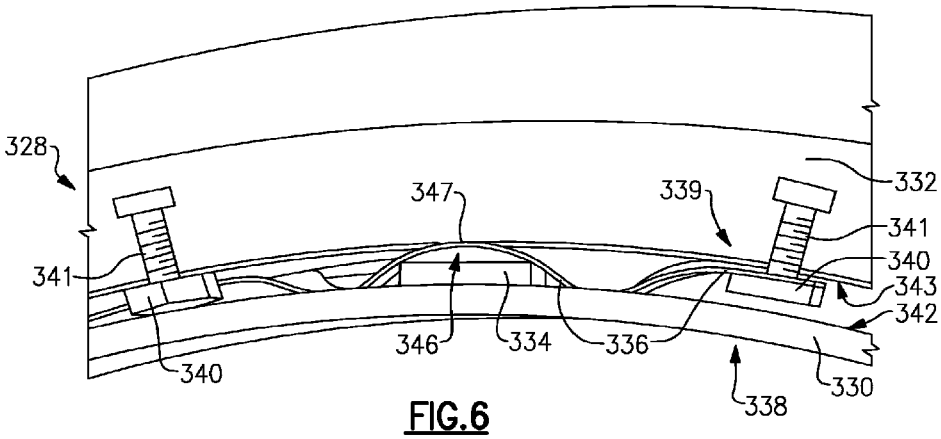
FIG. 6 is a partial sectional view of an example gas turbine engine shroud of FIG. 3 with a first annular ceramic wall and a second annular metallic wall connected with a spring.

Referring to FIG. 6, another example gas turbine engine shroud 328 is shown. The example gas turbine engine shroud 328 includes a first annular wall 330 made of ceramic, and a second annular wall 332, made of metallic materials. The inner side 343 of the second annular wall 332 faces the outer side 342 of the first annular wall 330 such that the second annular wall 332 encloses the first annular wall 330. The inner side 338 of the first annular wall 330 is in contact with high temperature gasses from the turbine engine.

The first annular wall includes a tab 334 extending out from the first annular wall 330 and pre-formed with the first annular wall 330. A number of attachment means 339 are attached to the second annular wall 332 and extend towards the outer side 342 of the first annular wall 330. An example attachment means are nuts 340 and bolts 341, however it is within the contemplation of this disclosure that other attachment means may be used. A spring 336 is attached to the nuts 340, which are used in conjunction with the bolts 341 attached to the second annular wall 332. In this example, the gas turbine engine shroud 328, the spring 336 has holes drilled through it such that the bolt 341 extend through the spring 336 and then the nut 340 is put on allowing attachment of the spring 336 between the nut 340 and bolt 341. The spring 336 creates an arc 346 over the tab 334. The top of the arc 346 is in communication with the second annular wall 332 at least at its apex 347. The spring 336 is also in communication with the tab 334. The spring 336 can be attached to both the tab 334, and the first annular wall 330 by being riveted in place is also within the contemplation of this disclosure that the spring 336 can be spot welded in place or attached using other known acceptable means.

In the present example, an example gas turbine engine shroud 328, the nuts 340 can move into different positions by moving along a vertical axis of the bolt 341 to create different tension throughout the spring 336. The spring 336 is attached to the nuts 340 and bolts 341 and flex in response to the movement of the nuts 340. In addition to allowing affixment between the second annular wall 332 and the first annular wall 330 it also allows the second annular wall 332 and first annular wall 330 to move closer or farther together as well as increasing ductility between the tab 334 and the second annular wall 332 such that frequency of cracks or breaks from stress is reduced. The stress is instead transferred into the spring 336, alleviating the stress on the first annular wall 330 and second annular wall 332.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A gas turbine engine shroud comprising:

a first annular ceramic wall including an inner side for resisting high temperature turbine engine gases and an outer side with a plurality of radial slots; and a second annular metallic wall positioned radially outward of and enclosing the first annular ceramic wall and including a plurality of radial tabs in communication with the slot of the first annular ceramic wall such that the first annular ceramic wall and second annular metallic wall are affixed, wherein at least one of the tabs includes an opening through the at least one of the tabs to increase ductility of the at least one of the tabs, wherein the first annular ceramic wall encloses rotatable turbine blades and the first annular ceramic wall surrounds stator vanes, wherein the opening extends into the second annular metallic wall.

2. The gas turbine engine shroud of claim 1, wherein the at least one of the tabs are distinct from and attached to the second annular metallic wall.

3. The gas turbine engine shroud of claim 1, wherein at least one slot is in communication with a spring strap attached to the second annular metallic wall.

4. The gas turbine engine shroud of claim 3, wherein the spring strap is attached to the second annular metallic wall in a first location by welding and in a second location by one of riveting or bolting.

5. The gas turbine engine shroud of claim 3, wherein the spring strap is also in communication with at least one tab of the second annular metallic wall.

6. The gas turbine engine shroud of claim 1, wherein the opening is a circular hole.

7. The gas turbine engine shroud of claim 1, wherein the opening is a rectangular hole.

8. A gas turbine engine shroud comprising:

a first annular ceramic wall including an inner side for resisting high temperature turbine engine gases and an outer side with a plurality of radial slots; and a second annular metallic wall positioned radially outward of and enclosing the first annular ceramic wall and including a plurality of radial tabs in communication with the slot of the first annular ceramic wall such that the first annular ceramic wall and second annular metallic wall are affixed, wherein at least one of the tabs includes an opening through the at least one of the tabs to increase ductility of the at least one of the tabs, wherein the first annular ceramic wall encloses rotatable turbine blades and the first annular ceramic wall surrounds stator vanes, wherein at least one slot is in communication with a spring strap attached to the second annular metallic wall, wherein the spring strap has the same profile as the shape of the slot.

* * * * *